US005241705A

United States Patent [19]

Barney et al.

[11] Patent Number: 5,241,705

[45] Date of Patent: Sep. 7, 1993

[54] REVERSIBLE COLLAR FOR CLOTHING

[76] Inventors: Tanis M. Barney, 11101 E. Rusty Spur Pl., Tucson, Ariz. 85749; Diana M. Wright, 568 S. Taaffe St., Sunnyvale, Calif. 94086

[21] Appl. No.: 929,394

[22] Filed: Aug. 14, 1992

[51] Int. Cl.[5] ..... A41D 3/14

[52] U.S. Cl. ..... 2/60; 2/129

[58] Field of Search ..... 2/60, 48, 49 R, 50, 2/51, 75, 80, 94, 98, 105, 106, 108, 115, 116, 119, 121, 122, 123, 131, 132, 134, 135, 139, 141 R, 142, 143, 244, 243 R, 243 B; 40/586, 610; 446/26, 27, 28, 488

[56] References Cited

U.S. PATENT DOCUMENTS

| | | | |
|---|---|---|---|
| 549,829 | 11/1895 | Shrier | 2/108 |
| 760,142 | 5/1904 | Nelson | 2/119 |
| 1,238,070 | 8/1917 | Weisel | 2/106 |
| 2,425,635 | 8/1947 | Nitzberg | 2/75 |
| 2,556,039 | 6/1951 | Landert | 2/119 X |
| 2,647,261 | 8/1953 | Rassner | 2/122 X |
| 2,685,690 | 8/1954 | Chrisman | 2/115 |
| 2,688,136 | 9/1954 | Freedman | 2/122 |
| 2,747,194 | 5/1956 | Ranieri | 2/119 |
| 3,064,265 | 11/1962 | Bridgewaters | 2/105 X |
| 3,518,785 | 7/1970 | Behr | 446/488 |
| 4,078,265 | 3/1978 | Condit | 40/586 X |
| 4,138,744 | 2/1979 | Pitzel | 446/27 X |
| 4,296,498 | 10/1981 | Vinson | 2/115 |
| 4,366,961 | 1/1983 | Busse | 446/488 X |
| 4,392,258 | 7/1983 | O'Neill | 2/115 X |
| 4,710,981 | 12/1987 | Sanchez | 2/115 |
| 4,754,500 | 7/1988 | Brucato et al. | 2/48 X |
| 4,860,387 | 8/1989 | Williams | 2/244 |
| 4,991,233 | 2/1991 | Hall | 40/586 X |
| 4,999,848 | 3/1991 | Oney | 40/586 X |
| 4,999,938 | 3/1991 | Behling | 40/612 X |

*Primary Examiner*—Clifford D. Crowder
*Assistant Examiner*—Jeanette E. Chapman
*Attorney, Agent, or Firm*—John P. Halvonik

[57] ABSTRACT

The invention is a collar especially adapted for children's clothing that may be reconfigured in order to present a clean front or, simply, change in the pattern that is showing. The garment has an outer layer and a second layer folded on the inside of the outer layer. Initially the second layer will be facing inward and will not be seen. One side of the outer layer is attached to one side of the collar and the other sode may be made integral with the collar. The attached side may be detached and attached to the other side of the collar in order to reveal the second layer and thus present a new pattern and/or fabric which is cleaner.

4 Claims, 1 Drawing Sheet

REVERSIBLE COLLAR FOR CLOTHING

FIELD OF INVENTION

1. Background of the Invention

The invention relates to the field of garments and, in particular, to a collar that is attached to the front of a children's shirt or other top and whose outer layer may be reversed in order to change the appearance of the front of the collar.

2. Description of the Prior Art

There are no reversible collars that the applicant is aware of that may be detached from one end and the attached to the other end of the collar in order to present a different fabric pattern on the inside.

SUMMARY OF THE INVENTION

The invention is a collar for attachment to garments and especially children's clothing that may be reversed in order to present a clean collar and/or a different pattern. The collar is constructed of at least two layers one of which is an upper layer which shows initially and the other is a lower layer which is on the inside of the upper layer and is initially covered. The upper layer is attached along one side of the collar through an attachment means. The attachment means may be buttons, snaps, VELCRO (a trademarked name) or other means. This layer may be folded back and attached to the other side of the collar to reveal the lower layer for a wearing option.

It is an object of the invention to provide a collar for attachment to clothing that may partially detached in order to present a cleaner fabric folded on the inside of the collar.

Another object of the invention is to provide a reversible collar for attachment to clothing that may be partially detached in order to present an alternate fabric pattern for wearing.

Yet another objective is to provide a children's collar that is reversible in order to present a clean collar.

Other objectives of the invention will become apparent to those skilled in the art once the invention has been shown and described.

DESCRIPTION OF THE PREFERRED EMBODIMENT

Figure 1:
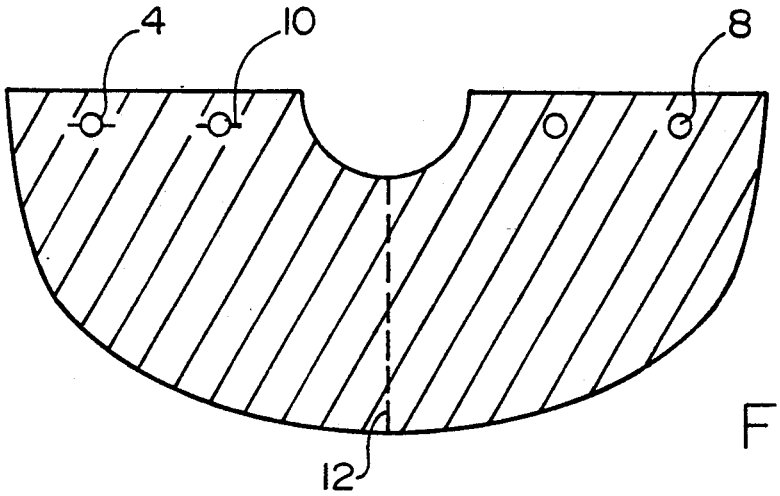
FIG. 1 shows the overall construction of the upper layer of the collar.

The overall construction of the upper layer is as shown in FIG. 1. The collar is essentially an arcuate shaped upper layer 1 that may be attache the front of a child's clothing and a lower layer 2 lying beneath the upper layer.

The upper layer is attached to both straight edges of the collar, see FIG. 1. An attachment means 4 located near one of the edges provides a detachable means for the collar in order that the collar may be folded back from that side to reveal the lower layer. The attachment means 8, 4 may be e.g.: buttons, snaps, hook and loop material, or other attachment means that can be detached as need be. 10 is a button hole, part of the attachment means when using the buttons.

The upper layer is of one pattern and/or fabric and the lower layer should be of dissimilar pattern and/or fabric. The inner surface 6 of the layer should be of a pattern similar to the lower layer 2. The different surface patterns of the various layers may differ in terms of fabric, pattern or other clothing characteristics.

In the preferred embodiment, the upper layer is detached along the buttons 4 at one edge of the lower layer in order to present the lower layer, folded on the inside of the outer layer, for an additional wearing option. It offers a different pattern and/or a cleaner collar. A second set of buttons of other attachment means 8 on the other edge of the upper layer (that edge opposite the first) allows the upper layer to be secured to this edge in a folded over position.

The upper and lower layers may be attached to one another at the midline 12 of the upper layer in order to facilitate the folding back of the upper layer.

Figure 3:
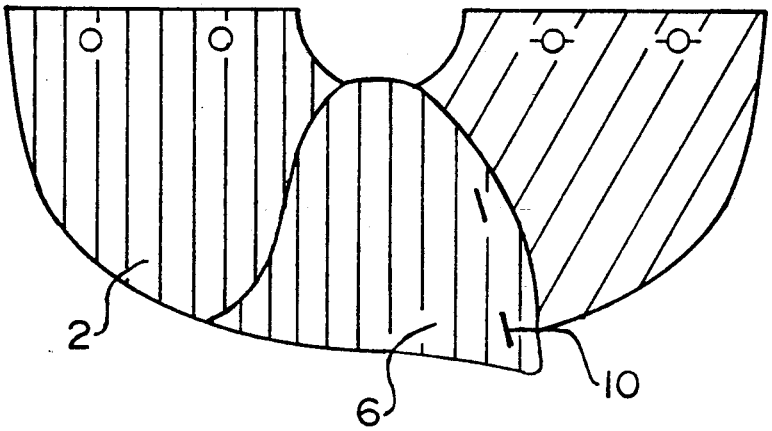
FIG. 3 shows the collar with upper layer retracted some and a portion of the inner surface revealed.

In the preferred embodiment, the upper layer series of button holes 10 for attachment of the buttons 4,8 second attachment means 8 may be on the upper layer itself since this part of the collar does not have to be moved. This allows the user to detach one side of the upper layer from that side of the collar and then attach this to the opposite side of the outer layer, see FIG. 3. In this manner, the upper layer is essentially folded in half along line 12 to present the lower layer 2 and the inner surface 6 of the upper layer for wearing exposure. The lower layer and the inner surface of the upper layer are likely to be cleaner as well as an optional wearing pattern.

Figure 2:
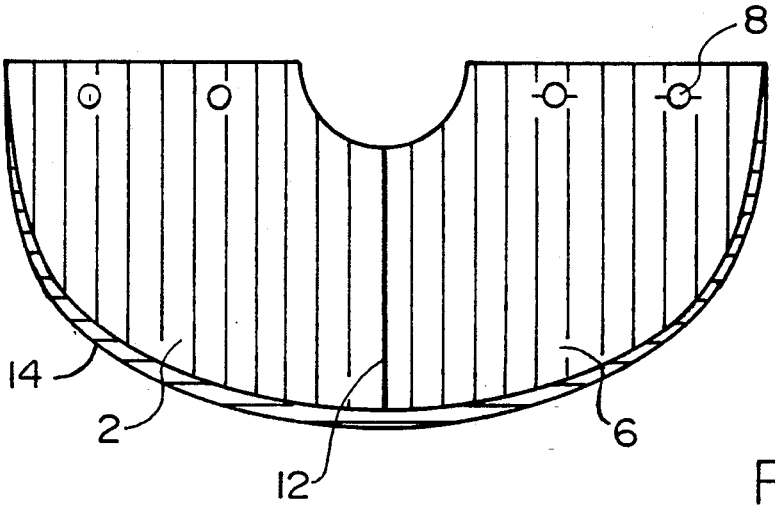
FIG. 2 shows the lower layer of the collar, upper layer fully retracted and optional third layer.

The two layers may be integrally joined to each other along the line 12 to facilitate the folding of the upper layer when the collar is reversed. 2 is the underside of the upper layer. It is of similar appearance to the second layer shown as 6. The second layer need only comprise half the size an shape of the upper layer as it is displayed in conjunction with 2. See FIG. 2.

It is preferred that the upper surface 1 and inner surface 6 of the upper layer be dissimilar in order to present the option of choosing from alternate patterns by folding over the upper layer. Of course, the color, the pattern, or the material itself may be varied.

A third layer 14 with a third pattern or fabric may also be used beneath the lower layer to present a third wearing option. In this case, the third layer operates as a facing or under layer and may be used by flipping the collar (including layers 1 and 2) over the head to reveal this third layer.

While it is preferred that the collar be used on children's clothing the garment should not be construed as being limited to only children's clothing. Of course the invention could come in many fabric styles and shapes and could find ready utility on women's clothing and probably also men's, although collars are not often seen on men's clothing nowadays.

Other constructions of the collar would also be possible without varying from the spirit of the invention. These include making the collar large enough to cover the entire front of the wearer.

Materials that could be used for tee collar would be any that readily come to mind as being suitable for clothing and including cotton, polyester, rayon, acrylic, linen, etc. The collar could of course be made in many different collars, patterns and shapes that find usefulness in a garment such as this.

I claim:

1. A reversible collar for attachment to garments said collar comprising: upper layer of clothing material of size suitable for a collar, said upper layer having an outer surface and an inner surface on that side opposite said outer surface, said inner and outer surfaces of dissimilar surface pattern, said upper layer having arcuate upper and lower edges and two relatively straight side edges, one of said side edges designated the detachable edge and the other of said side edges designated the fixed edge, a garment attachment means on said upper layer and near said fixed edge, said upper layer having at least one complimentary attachment means for mating with said attachment means, said complimentary attachment means located near said detachable edge, a lower layer of clothing having surface pattern similar to said surface pattern on said inner surface of said upper layer, said upper layer attached to said lower layer along a line running through the middle of said upper and lower arcuate edges, said lower layer having a second attachment means for attachment to said complimentary attachment means on said upper layer, so that said complimentary attachment means may be detached from said second attachment means in order to present a clean surface comprising said inner surface and said lower layer.

2. The apparatus of claim 2 where said complimentary attachment means comprises at least one button hole and said first and second attachment means each comprises at least one button.

3. The apparatus of claim 1 where said complimentary attachment means comprises hook and loop material strip and said first and second attachment means comprises corresponding strips of hook and loop material.

4. The apparatus of claim 1 where said complimentary attachment means and said first and second attachment means comprises snaps.

* * * * *